US005993731A

United States Patent [19]

Jech et al.

[11] Patent Number: 5,993,731

[45] **Date of Patent: *Nov. 30, 1999**

[54] PROCESS FOR MAKING IMPROVED NET SHAPE OR NEAR NET SHAPE METAL PARTS

[75] Inventors: David E. Jech; Juan L. Sepulveda; Anthony B. Traversone, all of Tucson, Ariz.

[73] Assignee: Brush Wellman, Inc., Cleveland, Ohio

[ * ] Notice: This patent is subject to a terminal disclaimer.

[21] Appl. No.: 08/966,041

[22] Filed: Nov. 7, 1997

Related U.S. Application Data

[63] Continuation-in-part of application No. 08/646,449, May 7, 1996, Pat. No. 5,686,676.

[51] Int. Cl.[6] ..... B22F 1/00

[52] U.S. Cl. ..... 419/19; 419/22; 419/30; 419/38; 419/58; 75/232; 75/247; 75/248

[58] Field of Search ..... 419/19, 22, 58, 419/56, 30, 38; 75/232, 247, 248

[56] References Cited

U.S. PATENT DOCUMENTS

| | | | |
|---|---|---|---|
| 3,492,113 | 1/1970 | Shafer . | |
| 4,752,334 | 6/1988 | Nadkarni et al. | 75/235 |
| 4,988,386 | 1/1991 | Oenning et al. | 75/247 |
| 5,004,498 | 4/1991 | Shimamura et al. | 75/233 |
| 5,039,335 | 8/1991 | Gondusky et al. | 75/246 |
| 5,409,864 | 4/1995 | Osada et al. | 437/209 |

OTHER PUBLICATIONS

K.V. Sebastian et al. High Density Tungsten–Copper Liquid Phase Sintered Composites from Coreduced Oxide Powders, Amer. Powder Metallurgy Institute, 1979, vol. 15, No. 1, 1979.

J. Johnson et al. Chemical Activated Liquid phase Sintering of Tungsten–Copper, Amer. Powder Metallurgy Institute, vol. 30, No. 1, 1994.

*Primary Examiner*—Ngoclan Mai

*Attorney, Agent, or Firm*—Calfee, Halter & Griswold, LLP

[57] ABSTRACT

The process for producing net shape or near net shape metal parts is improved by sintering a compact in a reducing atmosphere where the compact contains a metal and chemically-bound oxygen in the form of a metal oxide, for example, and the chemically-bound oxygen is in an amount sufficient to improve the sintering of the compact. Improved sintering is facilitated when the metal oxide forms a metal/metal oxide eutectic during reduction of the chemically-bound oxygen in a reducing atmosphere during the sintering process. The compact can contain a metal oxide and a solution compound to produce an alloy part, provided the chemically-bound oxygen is present in an amount sufficient to improve sintering. In a preferred embodiment, the compact also contains a reinforcement compound and is sintered to make a metal matrix composite. The resultant density of the near net shape metal parts made by the improved sintering process is preferably about 97% or more of the theoretical density.

42 Claims, 7 Drawing Sheets

PROCESS FOR MAKING IMPROVED NET SHAPE OR NEAR NET SHAPE METAL PARTS

This application is a continuation-in-part of U.S. application Ser. No. 08/646,449 filed May 7, 1996, for "Process for Making Improved Copper/Tungsten Composites," now U.S. Pat. No. 5,686,676.

BACKGROUND

1. Field of the Invention

The present invention relates to a process for making improved net shape or near net shape metal parts using powder metallurgy. More specifically, the process of the present invention sinters a compact containing a metal and chemically-bound oxygen in the form of a metal oxide powder in an amount sufficient to improve the sintering process. The chemically-bound oxygen is reduced during the sintering process which takes place in a reducing atmosphere. In addition, the compact can contain a metal oxide and a solution compound to produce a metal alloy part. In a preferred embodiment, the compact contains particles of a reinforcement compound having a melting point higher than the metal in the compact.

2. Description of Related Art

Advanced metal alloys and metal matrix composites have been produced for many years using conventional powder metallurgy procedures. With oxidized metals being undesirable in conventional sintering processes, metal powders that contain no more than about 0.1 to 1.0% by weight oxygen are used to make compacts prior to sintering. Conventional metallurgical processes include reduction prior to compaction and sintering to ensure a minimum level of oxygen in the system.

Green compacts can be made by various forming technologies which include extrusion, roll compaction, cold isostatic pressing, dry pressing and metal injection molding. The dimensions of the green compact are determined by the size of the die, taking into account the dimensions of the finished part and the shrinkage during sintering. In most cases, the powder is compacted into green parts using conventional uniaxial mechanical or hydraulic dry presses at a pressure of 45,000 to 55,000 psi. Extrusion forming is used for rods, tubes and sheaths having a fixed cross section. Roll compaction is advantageously used for large, flat and thin substrates. Cold isostatic pressing is preferred for large parts, whereas, dry pressing is more economically feasible for small, simple geometric parts which must be produced in large volumes. Metal injection molding which utilizes one of a variety of binders can economically produce parts of complex geometry in large volumes. The microelectronics and diode industries, for example, require a large-volume production of metal parts having tight tolerances for use in high reliability applications.

An important objective in the production of advanced alloys or metal matrix composites using powder metallurgy technology is to produce sintered parts in which the fired density approaches theoretical. Depending on the metal system employed, there is a significant difference in the physical properties of parts as their densities increase from about 96% to 99.5% of theoretical. For example, parts made of 4640 steel have an ultimate tensile strength which ranges between about 700 to 990 Mpa, a tensile yield which ranges between about 630 to 900 Mpa, and tensile elongation which ranges between about 2% and 15% at densities between 96% and 99.5% of theoretical, respectively. See German, Randall M., *Powder Metallurgy Science*, Metal Powder Industries Federation, 2nd Edition, 1994, p. 307. In conventional technologies, key variables affecting density for powder metallurgy processing, include the sintering temperature, the compaction pressure and the particle size of the powder. Other groups of researchers have found that it is important during the powder metallurgy process to minimize the amounts of oxygen and impurities in the system. German, Randall M., *Powder Metallurgy Science*, p. 307.

Metal matrix composites, in particular, provide design flexibility since key properties may be tailored to meet design specifications. In addition, metal matrix composites are synergistic in that the lower melting metal enables material transport within the compact at lower processing temperatures, whereas the higher melting reinforcement compound provides improved physical properties of the finished product. However, it is commonly known that a main disadvantage associated with composites is that the conventional processes for making them are complicated and yield low density parts. For example, in the case of low cost steel systems a density greater than 85% of theoretical is difficult to achieve.

The production of metal matrix composite parts which have consistent material ratios is important. As an example, copper/tungsten and copper/molybdenum composites are widely used in various electronic applications due to their relatively high thermal conductivities of 150–250 W/mK. Moreover, because the coefficient of thermal expansion of the composites can be controlled by varying their Cu/W and Cu/Mo ratios, these composites find significant use in electronic packaging applications where tailoring the composite to match the thermal expansion characteristics of the chip or other device attached thereto is highly desired.

Metal matrix composite parts having high-density/specific gravity and low porosity are also desirable in certain applications. For example, composites having high specific gravity can be used as counterweights in sport equipment, automotive parts and many other mechanical applications.

Metal matrix composites can be made by a number of techniques. In one technique, known as infiltration, a shaped article formed from a sintered mass of reinforcement particles is contacted with molten metal. As a result, the molten metal is infiltrated into the voids and interstices between the sintered reinforcement particles, thereby forming a completed composite.

In another technique, a powdery mixture of copper oxide particles and tungsten oxide particles is reduced in a dry (the dew point is less than −40° C.) hydrogen atmosphere. The reduced powder is mixed with or without a binder, and the mixture is compacted and sintered. Additional metal can be added by infiltration if desired. See U.S. Pat. No. 3,382,066 to Kenney et al., the disclosure of which is incorporated herein by reference.

A similar technique is illustrated in U.S. Pat. No. 5,439,638 to Houck et al., the disclosure of which is also incorporated by reference. In this technique, a mixture of reinforcement particles such as tungsten powder, metal oxides such as copper oxide powder, and optionally, cobalt powder is milled in an aqueous medium to form a slurry. The liquid is removed from the slurry via a spray dry process to form spherical, flowable agglomerates. The agglomerates are subjected to a reducing atmosphere to form a flowable tungsten/copper composite powder, and the powder then compacted and sintered to form the copper/tungsten composite.

There are many disadvantages to the above infiltration and co-reduction of oxide powder processes. For example, infiltration processes are generally unable to produce net shape parts. Parts produced by infiltration must either be pressed again via a second compaction process or be machined into final shape, thereby greatly increasing complexity of manufacture and cost. Also, typical infiltration processes require the extra steps of binder burn-off and pre-sintering. Moreover, in such processes, the pre-sintered compact is often relatively friable, which may also result in part breakage and a lower yield. Also, during the infiltration process, which is typically carried out in a separate furnace, excess metal may form pools or bleedout, resulting in the production of defective parts which must be discarded, or at least subjected to extra machining after sintering. Infiltration may also require special fixtures and complicated furnace equipment. Processes involving co-reduction of oxide powders also involve extra processing steps and are, hence, inherently complex. Also, machining after firing is still necessary in many instances. Because of these complexities and disadvantages, commercial manufacture of high quality, metal matrix composites is still difficult to achieve consistently and economically in large volumes.

Accordingly, there is a need for a new process for producing advanced metal alloy parts and metal composite parts, which is easier and less expensive to carry out than prior art processes and which is capable of producing parts with densities of about 97% and preferably about 99.5% of theoretical, rapidly and consistently.

SUMMARY OF THE INVENTION

In accordance with the present invention, metal parts having densities approaching theoretical can be produced by sintering a compact in a reducing atmosphere if the compact contains a metal and chemically-bound oxygen, and the oxygen is present in sufficient amount to produce a metal/metal oxide eutectic having a melting temperature lower than the pure metal. Preferably, the compact contains a metal in its oxide form, and during sintering in a reducing atmosphere, the metal oxide reduces to metal. As the reduction reaction continues, the reduced metal and metal oxide form a metal/metal oxide eutectic until the metal oxide is depleted. The improved process of this invention is achieved by a compact that contains sufficient metal oxide particles, and the metal is selected from the group consisting of copper, nickel, iron, chromium and any element in oxide form which, when reduced during sintering, is capable of forming a metal/metal oxide eutectic having a melting temperature lower than the pure metal. Alternatively, improved sintering can result when the compact contains a metal oxide and additionally the same metal in metallic form if the metal oxide is present in an amount sufficient to improve the sintering process.

If the metal which forms a eutectic is not present in its oxide form, oxygen may be provided by alternative means. For example, oxygen can be present in a sintering environment that contains moisture, or a compact can contain a material which will decompose to yield oxygen for reaction with the metal to form a metal/metal oxide eutectic.

In another embodiment, the compact further contains a solution compound which, upon sintering, forms a solid solution with the metal to produce near net shape metal parts which are alloys. A solution compound is a metal which contains at least one element which is different from the metal in the compact. A compact, preferably containing a metal oxide and a solution compound, is sintered in a reducing atmosphere to produce alloy parts having densities approaching theoretical.

In accordance with a preferred embodiment, a compact further contains a reinforcement compound to produce near net shape metal parts which are metal matrix composites. A reinforcement compound has a melting temperature at least several degrees higher than the melting temperature of the metal in the compact and at least several degrees higher than the melting temperature of the solution compound, if a solution compound is present. A compact preferably containing a metal oxide and a reinforcement compound, or alternatively, a metal oxide, a reinforcement compound and a solution compound is sintered in a reducing atmosphere to produce metal parts which are metal matrix composites having densities approaching theoretical.

The sintering can be further facilitated if the powders used as raw materials are combined together to form free-flowing agglomerates prior to forming the sintering compact, the agglomerates further containing chemically-bound oxygen and preferably being made without reducing any metals in the agglomerates to a metallic state. The sintering process is further facilitated by including moisture in the reducing atmosphere, at least during the initial stages of the sintering profile, to prolong the life of the eutectic.

The present invention still further provides a process for eliminating the binder by thermal decomposition and sintering the compacts in one single unit operation, thereby reducing the residual carbon in the compact to very low levels.

BRIEF DESCRIPTION OF THE DRAWINGS

The present invention may be more readily understood by reference to the following drawings wherein.

DETAILED DESCRIPTION

In accordance with the present invention, a compact containing a metal and chemically-bound oxygen is sintered in a reducing atmosphere to produce improved metal parts. Preferably, the metal and oxygen are bound together as metal oxide particles. The improved process of the present invention provides the advantage of a lowered sintering temperature (in some cases as much as 100° C.), a faster cycle time, and production of near net shape parts having increased density.

Figure 1:
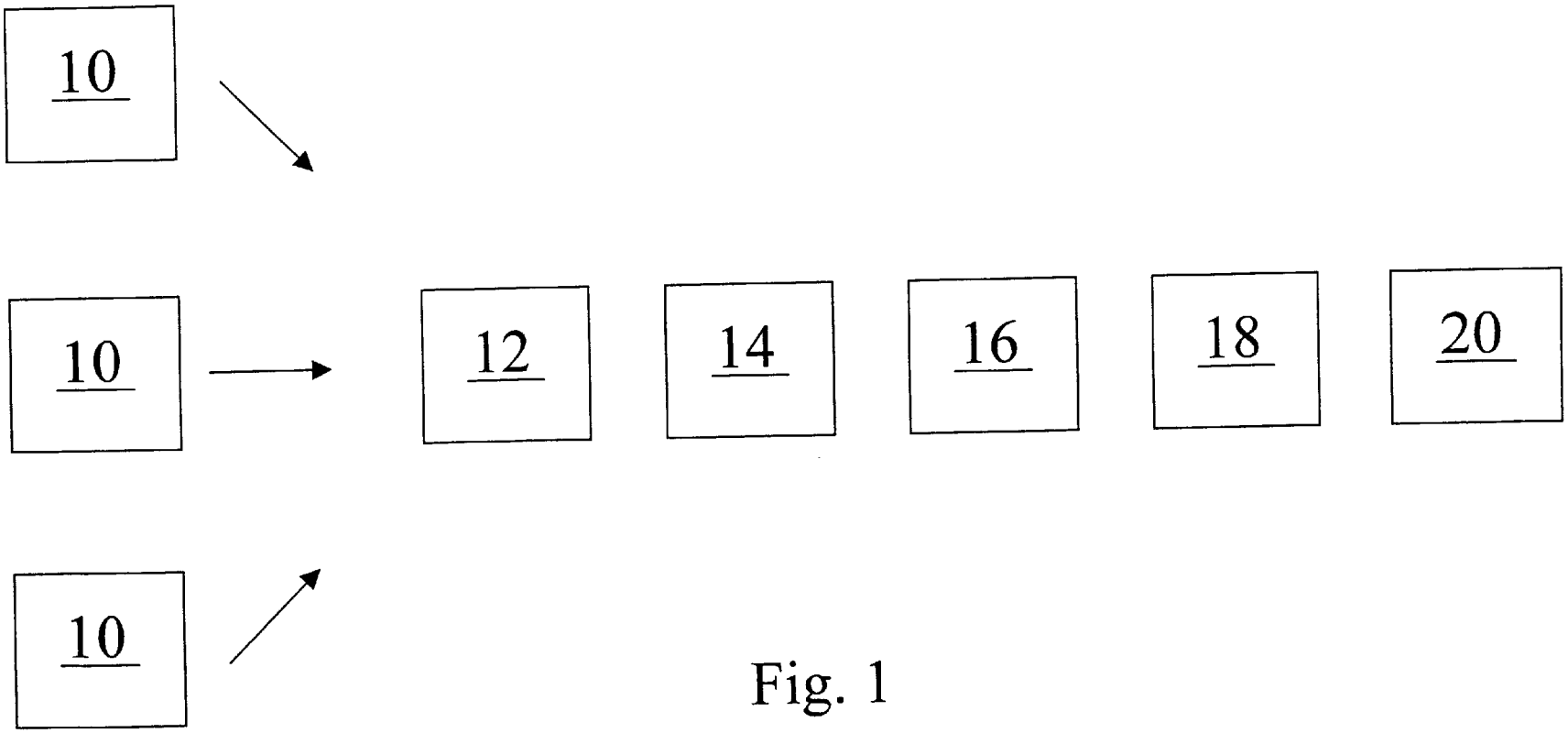
FIG. 1 is a schematic flow diagram of one embodiment of the invention process.

A flow scheme for one example of the process for making near net shape metal parts is illustrated in FIG. 1. In this flow scheme, the raw material powders used in the inventive process are transported from individual supply containers in a raw material station 10 into admixing station 12 where they are intimately admixed together. From admixing station 12, the admixed raw materials are then transferred to an agglomerator 14 where they are formed into agglomerates as further discussed below. These agglomerates are then transferred to compaction station 16 where they are charged into a suitable mold and compacted to form a green compact. The green compact is then transported into a sintering station 18, such as an oven, where it is sintered to form a completed compact as generally shown at 20.

Details of the inventive process are discussed below.

Raw Materials

The process of this invention requires that a compact contain a metal and chemically-bound oxygen in an amount sufficient to improve sintering in a reducing atmosphere. Preferably, the metal and oxygen are bound together as metal oxide particles. When a compact contains a metal oxide, the metal oxide reduces to metal when sintered. The metal preferably is selected from the group consisting of copper, nickel, iron, and chromium. In the early stages of sintering, metal and metal oxide form a metal/metal oxide eutectic having a melting temperature lower than the metal. A eutectic composition is a combination of metal and metal oxide components having the lowest melting temperature of any ratio of the two components. A complete definition of a "eutectic" is available in Levin, Ernest M., *Phase Diagrams for Ceramists*, Fourth Printing, The American Ceramic Society, 1964, p. 6, which is hereby incorporated by reference herein. Thus, the metal/metal oxide forms a liquid when the sintering temperature is approximately equal to or greater than the eutectic temperature. The metal/metal oxide eutectic has a lower viscosity in the liquid state. This allows increased particle rearrangement and material transport within the compact and results in a denser part.

For example, pure copper has a melting temperature of 1083° C. whereas the copper/copper oxide eutectic temperature is 1065° C. When a compact containing copper oxide is sintered in a reducing atmosphere, the oxygen is released and elemental copper forms. As the reaction progresses at a temperature near or above the eutectic temperature, copper/copper oxide eutectic forms throughout the compact and liquefies. Copper/copper oxide is present in the compact in changing proportions until the copper oxide is depleted and the reduction process is complete. Although the metal/metal oxide eutectic that forms at some stage during sintering has a short life, the liquefication thereof increases the density of the near net shape metal parts.

Likewise, it is known that nickel, iron and chromium each form a metal/metal oxide eutectic during sintering in a reducing atmosphere where the sintering temperature is about equal or greater than the eutectic temperature. Table 1 lists the melting temperature of these metals and the metal/metal oxide eutectic temperatures as reported by Hansen, Max, *Constitution of Binary Alloys*, N.Y., Genium Publishing Corporation, Third Printing 1991.

TABLE 1

| Material | Copper | Nickel | Iron | Chromium |
|---|---|---|---|---|
| Melting Temp (metal) | 1083° C. | 1453° C. | 1535° C. | 1890° C. |

TABLE 1-continued

| Material | Copper | Nickel | Iron | Chromium |
|---|---|---|---|---|
| Eutectic Temp (metal/metal oxide) | 1065° C. | 1438° C. | 1370° C. | 1660° C. |

The improved process of this invention is achieved when a compact contains a metal oxide which is capable of forming a metal/metal oxide eutectic during sintering in a reducing atmosphere. The phase diagrams of metal/metal oxides including copper, nickel, iron and chromium, and others are described in Hansen, Max, *Constitution of Binary Alloys*, N.Y., Genium Publishing Corporation, Third Printing 1991.

As stated above, the sintering process is improved when the compact contains metal oxide particles, and the metal is selected from the group consisting of copper, nickel, iron, chromium, and any metal in oxide form which can form a metal/metal oxide eutectic in a reducing atmosphere. Some metal/metal oxide eutectics, however, may be less practically applied to metal injection molding, such as, for example, silver, which forms a silver/silver oxide eutectic only at a very high pressure. Alternatively, the compact may contain metal particles in oxide form mixed with metal particles of the same metal in metallic form, the metal oxide particles being in an amount sufficient to improve the sintering process.

In addition, the benefits of the improved process disclosed herein are achieved when the compact further includes a solution compound which, upon sintering, forms a solid solution with the metal. A solution compound is one or more elements, at least one of which is different from the metal in the compact. In such a case, a compact preferably containing particles of metal oxide and particles of solution compound, is sintered in a reducing atmosphere to form a near net shape metal part which is an alloy. A compact containing a metal oxide in a sufficient amount, the metal being selected from the group consisting of copper, nickel, iron and chromium, forms a metal/metal oxide eutectic in the presence of a solution compound. During sintering, the metal oxide is reduced to a metal, and at some point during the reduction reaction a metal/metal oxide eutectic composition forms and liquefies. The solution compound and the metal form a homogeneous solution, thereby producing a metal alloy part.

A solution compound can be a metal in elemental form. For example, a compact which contains cuprous oxide particles and iron particles as the solution compound is sintered in a reducing atmosphere to yield near net shape iron-copper alloy parts having increased density. Solution compounds can include but are not limited to copper, nickel, iron, chromium, zinc, tin, beryllium, antimony, titanium, silver, cobalt, aluminum, niobium and combinations thereof. Upon sintering, the solution compound and the metal form a continuous phase. An exemplary list of metal alloys which can be made by the process of this invention includes copper-phosphorus; copper-zinc (bronze); copper-tin (brass); copper-beryllium; copper-iron; copper-tin-antimony; copper-titanium; nickel-iron; nickel-silver; nickel-copper; nickel-cobalt; iron-copper; iron-titanium; iron-copper-carbon; iron-copper-nickel; iron-chromium; iron-copper-tin; copper-nickel-titanium-aluminum; nickel-copper-titanium; and chromium-nickel-niobium.

In a preferred embodiment, a reinforcement compound is included in the compact to form a metal matrix composite. A reinforcement compound has a melting temperature several degrees higher than the metal in the compact and higher than the solution compound, if a solution compound is present. A compact preferably contains a metal oxide and a reinforcement compound, or a metal oxide, a reinforcement compound and a solution compound, and is sintered in a reducing atmosphere to produce alloy parts having densities approaching theoretical.

The reinforcement compound is any material which is insoluble to the metal, and the solution compound if present, under sintering conditions. Reinforcement compounds used in the process will have melting temperatures higher, and preferably several hundred degrees higher, than the metal which forms a eutectic within the given sintering temperature range.

Reinforcement compounds which may be used include tungsten, molybdenum, tantalum, titanium carbide, tungsten carbide, tantalum carbide, chromium carbide, beryllium oxide, aluminum oxide, silicon carbide, boron nitride, aluminum nitride, silicon nitride, iron alloys such as 64% iron/36% nickel (Invar®) and 54% iron/29% nickel/17% cobalt (Kovar®). Carbon particulates and carbon fiber can be included in the compact if the compact is sintered in a very dry atmosphere, i.e. a dew point about −40° C. Many other reinforcement compounds may be included to produce the desired metal matrix composite required for a specific application.

The finished composite part can be characterized by two separate phases. The continuous phase is represented by the metal and the solution compound and combinations thereof in solid solution. The discrete phase is represented by at least one reinforcement compound.

pools are found in the composite which is made by the process of the current invention. A composite having a higher degree of homogeneity throughout will possess more isotropic properties. For example, a copper/tungsten composite made by the process of the present invention will have more uniform conductivity and more uniform thermal expansion throughout the body.

As disclosed above, a preferred ingredient in the raw material package is a metal oxide. In accordance with the present invention, sintering of the compacts proceeds in an improved manner if a metal oxide is present in the compact. Although not wishing to be bound to any theory, it is believed that the inclusion of chemically-bound oxygen in the compact causes at least one metal/metal oxide eutectic to form during the sintering operation. It is further believed that at least one eutectic composition that is formed has a lower melting point and lower viscosity than the other raw materials in the compact, and thereby facilitates sintering through lowering of the temperature necessary for sintering or increasing final product density, or both. Table 2 below shows a non-exhaustive list of advanced metal alloys and metal matrix composites which can be made using a sintering temperature of less than 1450° C. in a dew point controlled environment and final product parts having a density of at least about 90%, preferably, at least about 97%, and most preferably, from about 99% to about 100% of theoretical.

TABLE 2

| Net Shape Parts | Metal | Solution Compound | Reinforcement Compound | Sintering Temperature |
|---|---|---|---|---|
| Pure Copper | Copper<br>Cuprous Oxide | — | — | 1175° C. |
| Copper-Beryllium Alloy | Cuprous Oxide | Cu—Be | — | 1175° C. |
| Copper-Phosphorus Alloy | Copper<br>Cuprous Oxide | Copper-Phos | — | 1175° C. |
| Copper/Beryllia Composite | Copper<br>Cuprous Oxide | Copper Phos | Berylia | 1175° C. |
| Copper/Alumina Composite | Copper<br>Cuprous Oxide | Copper-Phos | Alumina | 1175° C. |
| Nickel | Nickel<br>Nickel Oxide | — | — | 1440° C. |
| Iron-Copper-Nickel Alloy | Cuprous Oxide<br>Nickel Oxide | Iron | — | 1440° C. |
| Copper-Beryllium/ Tungsten Composite | Cuprous Oxide | Cu—Be | Tungsten | 1210° C. |
| Copper-Phosphorous/ Tungsten Composite | Cuprous Oxide | Copper-Phos | Tungsten | 1210° C. |
| Iron-Nickel/Tungsten Composite | Nickel Oxide | Magnetite (Iron Oxide) | Tungsten | 1440° C. |
| Copper-Nickel/Tungsten Carbide Composite | Cuprous Oxide | Nickel Oxide | Tungsten Carbide | 1440° C. |
| Copper/Silicon Carbon | Cuprous Oxide | — | Silicon Carbon | 1175° C. |
| Copper/Aluminum Nitride | Cuprous Oxide | — | Aluminum Nitride | 1175° C. |
| Copper/Tungsten | Cuprous Oxide | — | Tungsten | 1175° C. |
| Copper/Molybdenum | Cuprous Oxide | — | Molybdenum | 1175° C. |
| Copper/Tantalum | Cuprous Oxide | — | Tantalium | 1175° C. |
| Copper/Tantalum Nitride | Cuprous Oxide | — | Tantalum Nitride | 1175° C. |

Figure 2A:
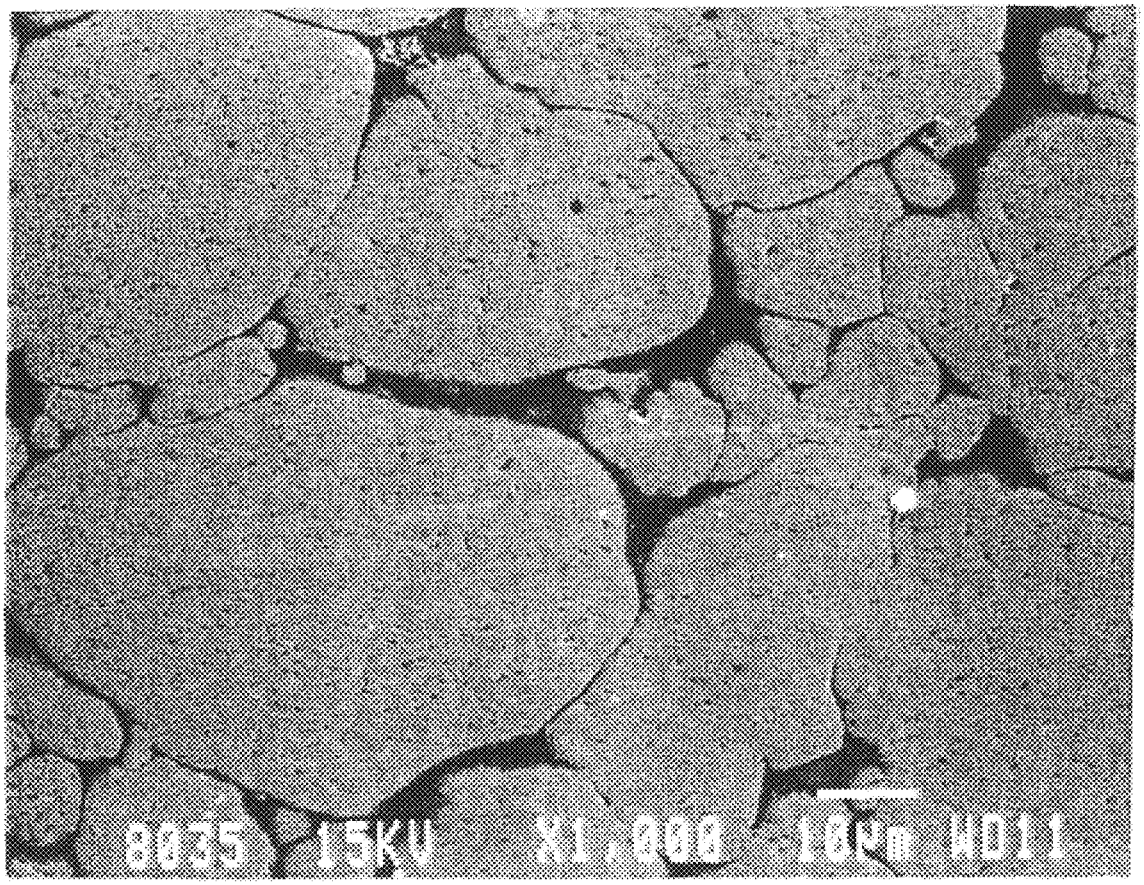
FIG. 2*a* is a scanning electronic microscope (SEM) micrograph of copper/tungsten composite made by the process of infiltration.
Figure 2B:
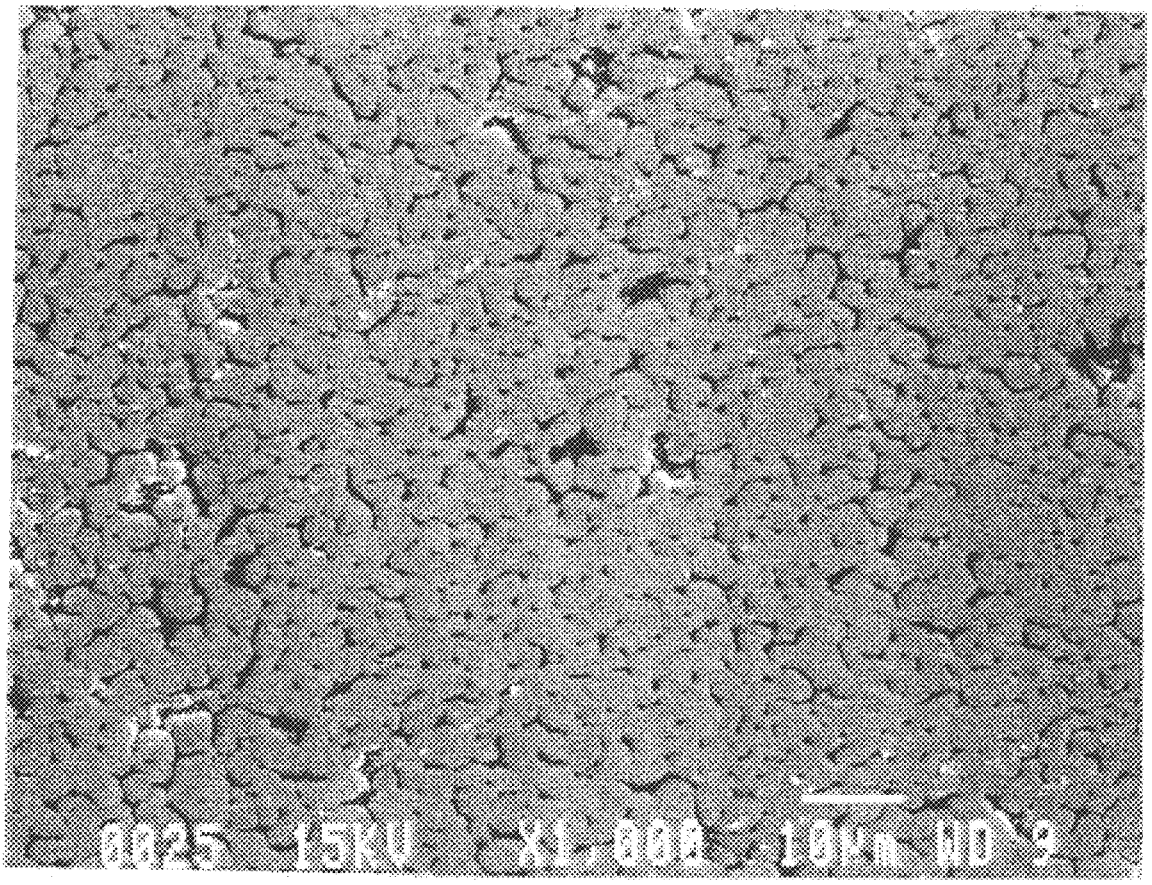
FIG. 2*b* is a scanning electronic microscope (SEM) micrograph of copper/tungsten composite made by the process of the present invention.
Figure 5:
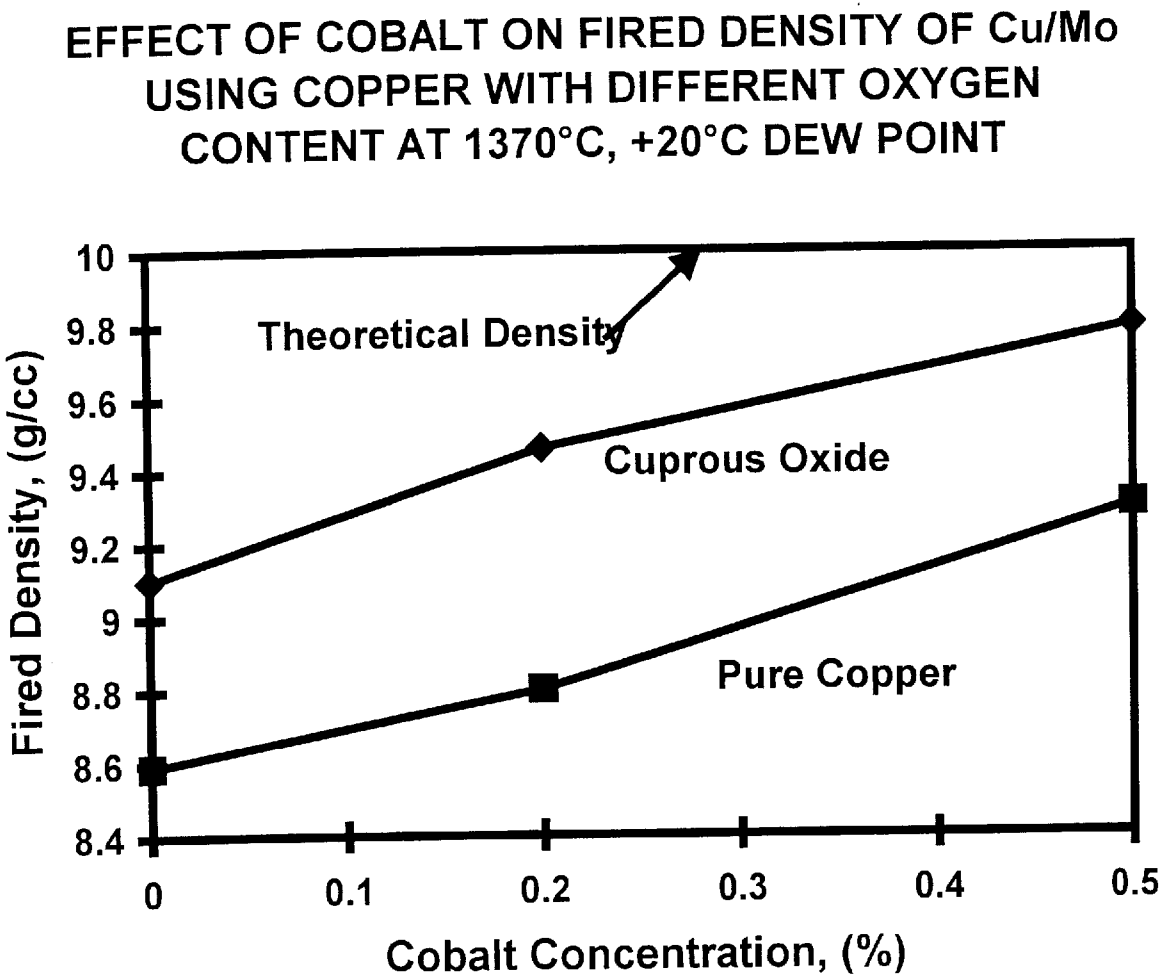
FIG. 5 is a graph illustrating the effect of the addition of chemically-bound oxygen used in sintering a copper/molybdenum composite in accordance with the present invention.

FIG. 2 shows photographs from an electron microscope showing the microstructures of copper/tungsten composites made by the process of infiltration (2*a*) and also made by the process of the present invention (2*b*). In comparing FIGS. 2*a* and 2*b*, it is obvious that a more homogenous phase distribution is obtained by the process disclosed herein. FIG. 2*a* shows the presence of copper pools surrounding the discrete phase of tungsten. In contrast, FIG. 2*b* shows that no copper The easiest way to supply oxygen to the compact is to have the metal present in its oxide form. In the case of copper/molybdenum, for example, FIG. 5 shows the additional benefit of sintering a compact containing metal oxide (cuprous oxide) versus sintering a compact containing metal (metallic copper). Oxygen which is chemically-bound to any element in the system can also be used provided that the compound decomposes under sintering to yield oxygen capable of reacting with the metal, and provided it is free of objectionable impurities. In making metal matrix composites, reinforcement compounds in oxide form may be used, again, provided that they decompose during sintering to yield oxygen. Examples of such materials are tungsten oxide ($WO_3$) or ($WO_4$) as well as molybdenum oxide ($MoO_3$) or $MoO_2$). Most organic compounds containing oxygen cannot be used for supplying oxygen, since they decompose at 300° C. or less. The oxygen available from such compounds is effectively lost to the system well before normal sintering temperatures are reached.

Alternatively, oxygen may be supplied to the compact by sintering the compact in a wet atmosphere (e.g. dew point from about 0° C. to 40° C.). However, if excessive oxygen or excessive oxygen is introduced in the sintering atmosphere, the oxygen may react with the heating elements of certain sintering furnaces (e.g. a molybdenum element furnace), and in such cases is undesirable. Also, compacts containing carbide or carbon have a propensity to burn in the presence of moisture, and such systems may require that the compact be sintered in a vacuum sintering furnace.

The particle size of the powders used as raw materials is not critical to forming a metal/metal oxide eutectic. However, as will be appreciated by those skilled in the art of powder metallurgy, the particle size and particle size distribution of powders used to form sintered articles does have a bearing on the properties of the ultimate products obtained. In accordance with well known principles, the particle size and particle size distribution of the raw material powders should be selected so as to maximize density and other desired properties in the composites produced. Each metal system has its own critical optimum particle size. In making copper/tungsten and copper/molybdenum metal matrix composites, for example, the different raw material powders should each have a mean particle size of about 0.3 to 50 microns, preferably from 0.3 to 10 microns, and most preferably 0.8 to 1.1 microns, as this size range promotes high density in the final sintered product obtained. Most powder metal materials are available commercially in these particle size ranges. They are also commercially available in larger particle size ranges, in which case such source powders can be mechanically worked, such as by ball milling, to reduce the particle size to the desired range.

Although the raw material powders can be directly obtained commercially in the desired particle size ranges, it is preferable that powders of larger mean particle size be obtained and vigorously admixed in a ball mill or other mechanical mixer prior to use. Most metals in their oxide form are brittle in nature and can therefore be ground to a finer, appropriate size as a result of such mechanical working. At the same time, mechanical working breaks up any agglomerates of metal particles which may have formed and, additionally, insures homogenous distribution of the individual particles.

The relative amounts of raw material powder used depends on the desired alloy composition or composite ratio in the final product. For example, copper/tungsten and copper molybdenum composites will have a Cu/W or Cu/Mo weight ratio of about 50% copper/50% tungsten or molybdenum to 5% copper/95% tungsten or molybdenum, more preferably about 10% copper/90% tungsten or molybdenum to 45% copper/55% tungsten or molybdenum, with Cu/W or Cu/Mo weight ratios of about 10% copper/90% tungsten or molybdenum to 30% copper/70% tungsten or molybdenum being especially preferred for electronic packaging applications. Tungsten-nickel-iron matrix composites having ratios such as 90% W/7% Ni/3% Fe or 95% W/3.5% Ni/1.5% Fe or 97% W/2.1% Ni/0.9% Fe are high density composites and typically used in counterweights or kinetic penetrators.

The exact amount of chemically-bound oxygen included in the compact to be sintered in accordance with the present invention is not critical. In practical terms, however, there should be enough chemically-bound oxygen present for the formation of a eutectic composition and this varies with each metal/metal oxide eutectic. It is preferable that chemically-bound oxygen is present in the form of metal oxide. When chemically-bound oxygen is present in the form of metal oxide, there should be enough metal oxide present to provide a noticeable improvement in the sintering process. Improved sintering is achieved when the amount of metal oxide in the compact represents at least about 1%, preferably, at least about 4%, and most preferably, at least about 20% by weight based on the total amount of metal in the compact. Oxygen may be introduced in the sintering environment by moisture. The chemically-bound oxygen as introduced by the metal oxide will have a greater impact on improving the density of the finished part than oxygen provided by moisture in the gas environment.

As mentioned above, it is believed that chemically-bound oxygen in the compact results in the formation of a metal/metal oxide eutectic under sintering conditions. In addition, a eutectic composition, because it is less viscous than molten metal or molten metal alloy, facilitates particle rearrangement through improved wetting and improved capillary flow within the compact. Sintering of the compact proceeds in an improved manner if chemically-bound oxygen is present as compared with identical processes carried out without chemically-bound oxygen. This improvement can be reflected in a number of different ways, and is typically reflected in a lowering of the sintering temperature necessary to achieve a particular result or the production of a denser sintered product at a given set of sintering conditions. Although the particular amount of chemically-bound oxygen present in the system is not critical, there should be a sufficient amount so as to provide a noticeable improvement in the sintering operation.

In addition to the foregoing components, other ingredients may be included in the raw material package. As is well known to those skilled in the art, organic binders are typically included in compacts to be sintered for the purpose of holding the compact together prior to the sintering operation. An organic binder is preferably included in the compacts used in the inventive process for the same purpose Essentially any organic material which will function as a binder and which will thermally decompose under sintering conditions without leaving an unwanted residue can be used in the inventive process. Preferred materials are various organic polymer resins such as polyester resins, polyvinyl resins, acrylic resins and the like. Most conveniently, such materials are supplied in the form of aqueous emulsions or dispersions, with acrylic emulsions being particularly preferred. In this regard, it has been found that acrylic emulsions, particularly Rhoplex® B-60A available from Rohm and Haas Company of Philadelphia, Pa., is particularly effective in that it provides the necessary green strength to the compact while at the same time thermally decomposing leaving very little residual carbon.

Additional conventional ingredients can also be included in the raw material package to be compacted and sintered in accordance with the present invention. If the raw materials are to be admixed in the presence of a liquid, particularly water, conventional cationic, anionic or non-ionic surfactants such as alkoxylated alkyl phenols (e.g. Tergitol®

D-683, available from Union Carbide Corporation of Danbury, Conn.) can be included. Viscosity control agents, other organic binders, and other materials can also be included, if desired.

Another ingredient that can be included in the raw material package to be compacted and sintered is a sintering aid. For example, it is well known that certain elements such as cobalt, iron and nickel facilitate sintering during the manufacturing of copper/tungsten and copper/molybdenum composites in particular. Such materials can be added in any form and in any manner known in the art. For example, particles of the sintering aid, either in metallic or in oxide form, can be added in appropriate amounts along with the other raw materials in the raw material mix. As more fully discussed below, the sintering aid can be supplied as contamination from the balls, rods or other pulverizing media used in mixing the raw materials together by milling.

Still another ingredient that can be included in the raw material package to be compacted and sintered in accordance with the present invention is a corrosion inhibitor, i.e. a chemical which impedes galvanic corrosion between two metals. It is well known in powder metallurgy that fine, particulate, metallic raw material powders such as pure titanium, pure aluminum and pure tungsten often exhibit spontaneous combustion. This occurs because of the high surface area and natural tendency of these particles to oxidize. Spontaneous combustion is a particular problem in manufacturing copper/transition metal composites such as copper/tungsten and copper/molybdenum composites, because environmental moisture can set up a galvanic couple between the copper and the transition metal in the raw material powders mix. Differences of more than 0.5 volts in oxidation-reduction electrode potential can cause galvanic coupling in the presence of moisture. Differences of as little as 0.3 volts could cause some reaction. This galvanic couple, in turn, can generate sufficient heat to initiate the spontaneous combustion phenomenon. Once spontaneous combustion begins, which typically occurs in dead areas of processing equipment or in open batches of product powder, the heat generated is sufficient to sustain the exothermic reaction through the entire powder mass.

In accordance with another aspect of the present invention, it has been found that spontaneous combustion of pyrophoric powders, especially fine metallic powders, can be retarded or eliminated by including in the powders a metal corrosion inhibitor. Examples of suitable metal corrosion inhibitors are benzotriazole, tolyltriazole and combinations thereof. The preferred corrosion inhibitor is benzotriazole.

Thus, in accordance with another preferred embodiment of the invention, a corrosion inhibitor is included in one or more of the raw material powders used for forming the inventive composite for reducing or eliminating spontaneous combustion. In a particularly preferred embodiment of the present invention, such corrosion inhibitors are introduced into the raw material package by treating the metal raw material powder with the corrosion inhibitor prior to admixture thereof with the other ingredients in the system. For example, copper powder or cuprous oxide powder can be soaked in a solution of the corrosion inhibitor in a suitable solvent such as isopropyl alcohol for a suitable period of time, e.g. for 12 hours, prior to admixture with the other ingredients in the system.

Admixture of Raw Materials

The various raw materials used in the inventive process, as described above, are intimately admixed to form a homogenous mass suitable for compaction. This can be accomplished in any conventional manner. For example, the raw materials can be mixed by means of mechanical mixers such as high shear mixers, blenders and the like. They can also be mixed in various types of mills such as ball mills, rod mills and so forth.

In a preferred embodiment, the raw materials are mixed in the presence of a liquid, preferably water. This may be accomplished in mechanical mixers, such as high sheer mixers or blenders (e.g. a Patterson-Kelly Blender or a V-blender), in which case the amount of liquid present should be relatively low, e.g. 0 to 10, preferably 1 to 4 wt. %. This may also be accomplished in various types of milling equipment, in which case the liquid content is usually considerably higher, for example, 40 to 90, preferably 60 to 70 wt. %.

Agglomerates

Once an intimate admixture of raw materials as described above is produced, it can be formed into a compact in any conventional manner. Preferably, however, the raw material admixture is formed into a mass of free-flowing agglomerates first and the agglomerates so formed then used to form the compact.

Forming agglomerates from raw material powders to be compacted and sintered into composites is known. However, in such processes, the raw material powders are typically subjected to a reducing atmosphere for reducing any oxides therein to their elemental state prior to formation of the green compact. The present invention differs from these earlier procedures in that the raw material powders, already containing chemically-bound oxygen, are not reduced to the metallic state prior to or after agglomeration. This maintains a significant amount of chemically-bound oxygen in the agglomerates when compacted and sintered, thereby making this oxygen available for forming a metal/metal oxide eutectic during sintering in accordance with the present invention.

Forming free flowing agglomerates from the above raw materials can be accomplished in a variety of different ways. Most easily, this is accomplished by spray drying a liquid mixture of the raw materials. Alternatively, the raw material admixture, typically containing at least some liquid, can be subjected to high sheer mixing until essentially all of the liquid evaporates, thereby forming agglomerates as the product. In either case, the agglomerates so formed can be screened to remove lumps and foreign matter if necessary.

As indicated above, the powders used as raw materials in the inventive process preferably have a certain mean particle size depending upon the metals used to promote high densities in the products obtained by sintering. Unfortunately, powders having a mean particle size of about 1 to about 50 microns, particularly those having a comparatively high portion of fines (that is, particle size less than or equal to 325 mesh, approximately 45 microns), do not flow easily. By forming agglomerates of the raw materials, the flowability of the material to be compacted is markedly improved. This enables the raw material to fill the compaction die much more easily than using unagglomerated raw materials. This, in turn, facilitates producing parts of complex shape with a high degree of reproducability on a commercial basis, since defects attributable to poor material flow into the compaction die are largely eliminated.

Preferably, agglomerates as described above are produced such that a mass of the agglomerates exhibits an angle of repose of 35° or less and a Hall flow rate of about 40 seconds or less per 50 grams according to ASTM Procedure B-213 90. More preferably, the agglomerate mass should exhibit an angle of repose of 30° or less and a Hall flow rate of about 30 seconds or less per 50 grams. In accordance with the present invention, it has been determined that agglomerates made in this manner exhibit the most desirable flow properties in terms of filling compaction dies of complex shape. As appreciated by those skilled in the art, producing agglomerates having these flow properties can be easily accomplished through adjusting the conditions of the agglomeration process as well as screening if necessary.

In a particularly preferred technique for forming copper/tungsten or copper/molybdenum agglomerates in accordance with the present invention, a mixture of raw material powders is first ground in a conventional tumbling ball mill in water until the median particle size ($d_{50}$) of the powder mass is reduced to 0.8 to 1.1 micron. After milling, the slurry is then discharged from the mill into mixing tanks. An acrylic emulsion is then added as an organic binder and the slurry so formed is then spray dried to form spherical agglomerates.

In order to introduce cobalt to the raw material mix when this technique is used, cobalt powder in the desired concentration can be introduced into the mill in addition to the other ingredients. The pulverizing media used in the mill is preferably formed from the raw materials in order to prevent contamination of the raw materials with unwanted ingredients. If tungsten is one of the raw materials, cobalt can be introduced into the system by using balls or other pulverizing media formed from tungsten carbide. Cobalt is the main sintering aid in the manufacture of tungsten carbide, and consequently cobalt from tungsten carbide pulverizing media will contaminate the raw materials being processed by ball milling. This phenomenon can be used in lieu of the separate addition of cobalt to supply cobalt as a sintering aid to the system. Likewise, an exemplary list of pulverizing media which can be used includes copper/tungsten, copper/molybdenum, nickel-iron/tungsten, alumina and beryllia to make composites containing these respective materials.

In another preferred embodiment for forming agglomerates containing tungsten, ultra fine metal oxide (mean particle size of about 0.8 micron), submicron tungsten (mean particle size of 1.1 micron) and ultra fine cobalt (mean particle size of about 1 micron) are thoroughly mixed in water, optionally including a dispersing agent and organic binder, and the dispersion so formed spray dried. In a particular example of this procedure, ultra fine cobalt powder is mixed in water containing a dispersing agent for 10 minutes, then metal oxide previously treated with benzotriazole is added and the mixture so obtained mixed for an additional 30 minutes. Ultra fine tungsten powder is then added and the mixture so obtained mixed for an additional 120 minutes. Finally, Rhoplex B-60A acrylic emulsion is added and mixed with the remaining ingredients for an additional 30 minutes, after which the mixture so obtained is sprayed dried.

In using any of the above methods for forming agglomerates, agglomerates are produced which, when dry, are in the form of a free flowing powder having an angle of repose of 35° or less and a Hall flow rate of about 40 seconds or less per 50 grams.

Compaction

The above raw materials, preferably in the form of a free flowing mass of agglomerate powder, are then compacted. This can be accomplished in accordance with any conventional technique. For example, the agglomerate powder can be pressed with either a hydraulic or mechanical press, typically at 15,000 to 30,000 psi, to form a green compact. The dimensions of the green compact are determined by the size of the die used, which in turn is determined by the dimensions of the desired finished composite, taking into account shrinkage of the compact during the sintering operation. Because the foregoing agglomerates exhibit superior flowability, as many as 30 composites or more can be produced from a single press per minute.

Sintering

After the green compacts are removed from the press, they are sintered in a reducing atmosphere. By reducing atmosphere is meant an atmosphere which is capable of reducing metal oxide to metal under sintering conditions. Essentially any gas can be used for the sintering atmosphere which will accomplish the above reduction. A reducing atmosphere containing nitrogen and hydrogen is preferred since it is effective, efficient and readily available. In some cases, depending on the type of metal in the compact, a reducing atmosphere containing hydrogen and mostly nitrogen is preferred.

Sintering is preferably accomplished using either a batch furnace or a continuous pusher type furnace. In either case, the furnace is preferably powered by molybdenum elements. Also, it is desirable that alumina, beryllia, other oxides, or other material which does not decompose or react under sintering conditions be used as a liner to support the compact in the furnace. Excessive wicking of metal or metal alloy out of the composite can occur if suitable liners are not employed. For example, molybdenum liners react with copper and are not usable to make parts containing copper.

Sintering is accomplished for a residence time and at a temperature sufficient to cause the green compact to be transformed into a sintered product, i.e. a product having a density of at least 97% of theoretical, preferably at least 99% of theoretical. Sintering temperatures vary according to the metal or metal alloy employed and the eutectic temperature (s) of the system/It is preferred that the sintering temperature be greater than or equal to at least one eutectic temperature that can be achieved in the system. Sintering conditions suitable for forming copper/tungsten and copper/molybdenum composites, for example, have been determined during the development of this invention. Sintering compacts containing copper oxide is conducted at temperatures from 800 to 1400° C., preferably 1000 to 1300° C., more preferably 1050 to 1250° C. for time periods ranging from 0.5 to 5, preferably 1 to 3, more preferably 0.5 to 1, hours. Sintering of compacts containing nickel oxide is conducted at temperatures from about 1300° C. to about 1550° C., preferably about 1400° C. to about 1500° C., and more preferably from about 1410° C. to about 1450° C. for the same preferred time ranges as with copper.

As appreciated by those skilled in the art, care must be taken during sintering to avoid sintering conditions which are either too benign or too severe. Sintering conditions which are too benign, i.e. insufficient in time or temperature, result in insufficient sintering and the production of product composites which have poor properties in terms of density, strength, fragility and the like. Sintering conditions which are too severe may cause the metal or metal alloy to be exuded from the composite body, thereby forming pools of metal or metal alloy on the composite surface.

An example of a sintering regimen which has been found to be particularly effective for manufacture of a copper/tungsten or a copper/molybdenum composite in accordance with the present invention involves heating the green compact from room temperature to about 1,050° C. over one hour, maintaining the temperature of the compact at 1,050° C. to 1,250° C. for about 50 minutes, and then decreasing the temperature of the composite so formed back down to room temperature over an additional 50 minutes.

In a preferred embodiment of the invention, moisture is included in the sintering atmosphere. Moisture in the sintering atmosphere can have two effects. The primary effect of water vapor is to promote sinterability of the composite. This effect is believed due to a prolongation of the life of the metal oxide in the metal/metal oxide eutectic. Improved sinterability attributable to moisture in the sintering atmosphere, as in the case of chemically-bound oxygen, is reflected in a number of different ways, the most common being an increase in density of the sintered composite obtained or a lowering of the sintering temperature necessary to achieve a particular result, or both. Second, if tungsten carbide pulverizing media is used, the steam converts any tungsten carbide that may be present as contamination from milling into tungsten metal. This is believed to occur by a two step reaction in which tungsten carbide is first converted into tungsten oxide, followed by the tungsten oxide so formed being converted into tungsten metal.

Figure 6:
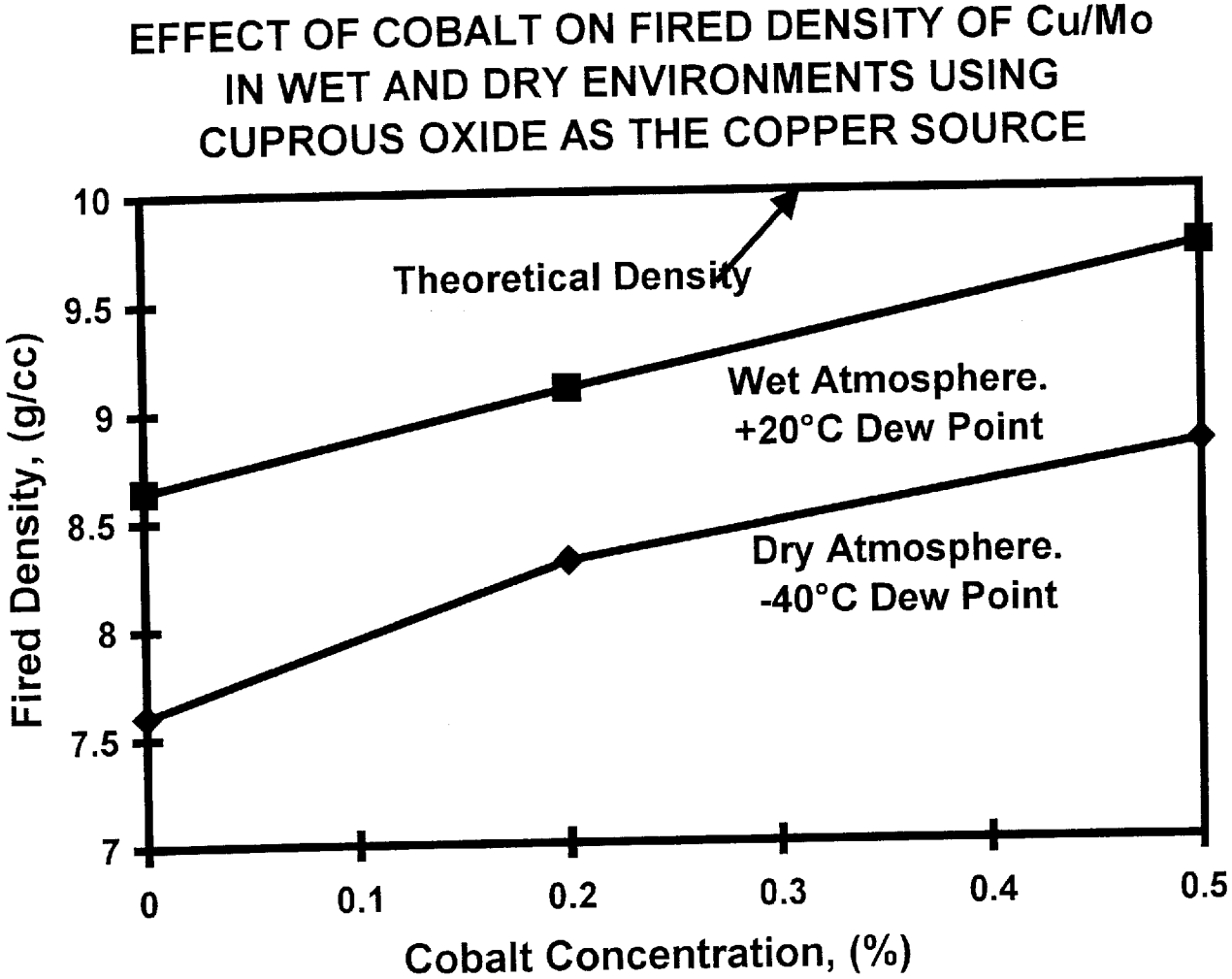
FIG. 6 is a graph illustrating the effect of moisture in sintering a copper/molybdenum composite in accordance with the present invention.

The amount of moisture to be included in the sintering atmosphere is optimized according to the raw materials used. Sufficient moisture should be included so that a noticeable improvement in the sintering operation is achieved, either in terms of the density of the product obtained or a reduction in sintering temperature. Good results have been obtained when the sintering atmosphere contains sufficient water vapor so that it is saturated with water at +20° C., i.e. so that the sintering atmosphere has a dew point of +20° C. Less moisture, e.g. dew points of 0° C. or even −10° C., is effective. FIG. 6 shows that the presence of moisture in a sintering environment noticeably increases the fired density of copper/molybdenum parts. Moisture as measured by 20° C. dew point in a copper/molybdenum system retards the reduction process and prolongs the life of the eutectic, and thus provides for increased particle rearrangement which results in denser parts. Some systems require a drier atmosphere, compacts containing beryllium or carbon (carbon tungsten) for example, because there is a tendency for them to burn in the presence of moisture.

Final Product

After sintering is complete, the composite so formed can be removed from the sintering furnace and used as is. Alternatively, it can be subjected to tumbling to smooth off sharp edges, eliminate fins generated during dry pressing and to burnish the composite surfaces.

Advanced alloys and composites produced in accordance with the present invention can be used in a variety of different electrical, mechanical and sporting good applications. For some applications in microelectronics which utilize copper/molybdenum, copper/tungsten, and copper/nickel/tungsten, it is sometimes desirable to provide the advanced alloy or composite parts, on one or more surfaces thereof, with a secondary metallic coating. This can be done, for example by plating with nickel using conventional plating processes such as electroless nickel plating, electro plating or the like. Electroless nickel plating is preferred because it produces a dense, uniform coating. Activation of the composite surface can be done with palladium activators or with a nickel strike. The use of a nickel strike is a lower cost process and is thus preferred. Electroless nickel is available with various contents of either boron or phosphorous. Mid-phosphorous (e.g. 7% P) is frequently used because it has a better balance between cost and performance. If desired, the advanced alloy or composite parts, after being plated with nickel, can be sintered at elevated temperature to bond the nickel to the surface of the composite and to reduce any nickel oxide that may have formed after plating. This can be done, for example, by heating the nickel-plated composite at 825° C. for 5 minutes in a wet (+20° C. dew point) 25% hydrogen/75% nitrogen atmosphere. Plated nickel is a very active surface and therefore susceptible to oxidation and staining. Nickel sintering passivates the nickel, thereby reducing its propensity for oxidation.

Metal-coated copper/tungsten or copper/molybdenum composites, for example, find wide applications in electronic packaging. If desired, such composites can be further plated with other metals such as gold, copper or silver. Historically, copper/tungsten substrates are brazed to a metallized ceramic. The usual method is to furnace braze with a copper/silver eutectic braze alloy. Other braze alloys or soft solders can also be used. Recently, electronic packages have been developed which require the chip to be attached directly to the copper/tungsten substrate. This requires a substrate to be plated with gold or other suitable metal because such plating is preferred for joining purposes. All of these techniques can be used in connection with some of the composites of the present invention to provide electronic packages suitable for a wide variety of different applications.

In accordance with the present invention, sintered alloy and composite parts of high density are produced very easily and without a number of the cumbersome, time consuming and expensive steps required in prior art processes. Also, the inventive process can produce metal parts with complex shapes rapidly, repeatedly and reliably. Variability in weight and physical dimension between successful parts is very small, which means that post sintering machining and other mechanical working can typically be eliminated.

These advantageous results are due to the improved sintering effect realized through the inclusion of metal oxide in the raw material compact. In addition, these advantageous results are also due, at least in part, to the use of agglomerates to form the sintering compact, as these agglomerates facilitate rapid filling of the compaction die very easily. These results are also due, in part, to inclusion of water in the sintering atmosphere as well as to the inclusion of chemically-combined oxygen in the compaction mass, as both of these procedures improve sinterability of the compact.

As previously indicated, the improved sintering effect realized through incorporating chemically-bound oxygen in the compaction mass is believed due to the formation of a metal/metal oxide during the sintering operation. Although a eutectic is formed at only a few degrees lower than the melting temperature of the metal, the liquid phase generated is believed to be less viscous and to facilitate material transport and particle realignment during sintering in a superior fashion. This eutectic is also believed to wet the compact powders better than a molten metal or a molten metal alloy during sintering. By including chemically-bound oxygen in the compacted mass subject to sintering, a simpler manufacturing procedure can be employed and products having a higher fired density can be obtained, as compared to the sintering processes of conventional methods.

In order to more fully and clearly describe the present invention so that those skilled in the art may better understand how to practice the present invention, the following examples are given. These examples are intended to illustrate the invention and should not be construed as limiting the invention disclosed and claimed herein in any manner.

WORKING EXAMPLES

The following working examples are provided to more thoroughly illustrate the present invention:

Example 1

Near net shape metal parts were produced using cuprous oxide and molybdenum powder. The raw material packages used to make copper/molybdenum composite parts are listed below in Table 3.

Benzotriazole (Cobratec® 99 made by PMC Chemical Company) was dissolved in 7.5 lbs of 60° C. water with mixing. The Alkoxylated alkyl phenol surfactant (Tergitol® D-683 made by Union Carbide Corporation) and the cuprous oxide were charged into the mixing tank and allowed to set for a minimum of 12 hours. The cobalt and one pound of water was added to the mixing tank and mixed for five minutes. The molybdenum was added to the 24 lbs of water and milled for five hours in a tumbling ball mill. The ammonia was added to the mixing tank containing cuprous oxide and mixed for two minutes. This mixture was then added to the molybdenum slurry in the mill and milled for two hours.

The particle size distribution was checked, and if the median size was less than four microns, then the mill was discharged. If the median particle size was coarser than four microns then the slurry was milled until the median particle size was finer than four microns. After the mill was discharged, the mill was rinsed three times with 6.5 lbs of additional water per rinse. The rinse water was added to the slurry after each rinse. The slurry was cooled at room temperature.

The Rhoplex® B-60A made by Rohm and Haas was screened through a 100 mesh screen before being weighed. The Rhoplex was slowly added to the slurry and mixed for a minimum of 8 hours. The slurry was then screened through a 40 mesh screen and the viscosity, specific gravity and pH were measured. The viscosity of the slurry was less than 20 seconds through No. 2 Zahn cup. The specific gravity was close to 2.51 g/cc and the pH was close to 8.5.

The mixture so obtained was then discharged from the mixing tank and spray dried in a Niro spray drier at 25 psi and an outlet temperature of 270–280° C. The spray dry operation formed spray dried agglomerate powder which after screening (65 mesh) exhibited a Hall flow rate of about 20 seconds per 50 grams of powder. The agglomerate powder so obtained was used to form metal composite parts. Each metal composite part was formed by charging the appropriate amount of agglomerate powder into a die having a disk shape and compressing the powder in a press at a pressure of 25,000 psi to form a green compact. The green compact containing copper/molybdenum was fired at 1450° C. for 45 min. in an Astro type furnace in a hydrogen atmosphere having a dew point of 20° C.

TABLE 3

| COMPONENT | AMOUNT (pounds) |
|---|---|
| Molybdenum Powder | 100 |
| Cuprous Oxide | 20 |
| Deionized Water | 52 |
| Cobalt | 0.6 |
| Benzotriazole (Cobrate ® ) | 0.80 |
| Surfactant (Tergitol ® D-683) | 0.76 |
| Ammonia | 1.1 |
| Acrylic Emulsion (Rhoplex ® B60A) | 3.1 |

After the composites were withdrawn from the furnace and cooled, they were visually inspected and their densities measured. As a result, it was determined that there was no metal bleedout. The density of the composite parts were measured and the average density of the composites was 9.75 g/cc which is 97.6% of theoretical.

Example 2

Near net shape copper/tungsten composite parts were made using the ingredients in Table 4 below. Benzotriazole corrosion inhibitor (Cobratec® 99 available from PMC Chemicals) was dissolved in isopropyl alcohol and particulate cuprous oxide was then added to the benzotriazole solution and the mixture was set for 12 hours.

Deionized water and cobalt metal having a mean particle size of 1 micron were charged into a mixing tank and mixed for ten minutes. Next, tungsten metal having a mean particle size of 1 micron was slowly added to the other ingredients in the mixing tank and mixed for an additional 120 minutes. Then the previously made-up mixture of cuprous oxide, benzotriazole and isopropyl alcohol was added and the mixture so obtained mixed for an additional 30 minutes. Rhoplex® B-60A acrylic emulsion was then added to the mixture and mixed for an additional 30 minutes. Thereafter, the mixture was recovered and spray dried in a Niro spray drier to form a flowable mass of particulate agglomerates which, after screening, exhibited a Hall flow rate of about 30 seconds per 50 grams.

Green compacts were made by compressing portions of the above flowable powdery mass at 25,000 psi. The individual green compacts were then fired in an Astro type furnace at 1,210° C. for 45 minutes in a hydrogen atmosphere containing sufficient water to exhibit a +20° C. dewpoint.

TABLE 4

| COMPONENT | AMOUNT (pounds) |
|---|---|
| Tungsten | 423.6 |
| Cuprous Oxide | 84.0 |
| Deionized Water | 105.1 |
| Cobalt | 2.7 |
| Isopropyl Alcohol | 18.5 |
| Benzotriazole (Cobratec ® 99) | 3.3 |
| Acrylic Emulsion (Rhoplex ® B60A) | 12.5 |

The composites were inspected visually and their densities determined. As a result, it was determined that copper bleedout was negligible and that the average density was 15.98 grams/cc, about 98% theoretical.

Example 3

The procedure of Example 2 was repeated except that a nonionic surfactant was used. The ingredients are listed in Table 5 below.

TABLE 5

| COMPONENT | AMOUNT (pounds) |
|---|---|
| Tungsten Powder | 423.6 |
| Cuprous Oxide | 84.0 |
| Deionized Water | 105.1 |
| Cobalt | 2.7 |
| Benzotriazole | 3.3 |
| Alkylated Alkyphenol (nonionic surfactant) | 2.5 |
| Isopropyl Alcohol | 18.5 |
| Acrylic Emulsion | 12.5 |

Upon analyzing the composites obtained, it was determined that copper bleedout was negligible and that the average density of the product obtained was 15.98 grams/cc, about 98% of theoretical.

Example 4

Copper/tungsten composites were made according to the procedure of Example 2 was used with a larger quantity of raw materials as listed in Table 6 below.

Tungsten metal powder, cuprous oxide and deionized water were charged into a ball mill containing tungsten carbide pulverizing media containing cobalt as a sintering aid. The tungsten powder, cuprous oxide powder were milled in water until the mean particle size thereof, $d_{50}$, was less than 1.2 microns, about 24 hours. Rhoplex B-60A acrylic emulsion was then added to the mill and the mixture milled for an additional 30 minutes. The mixture was then discharged from the mill and spray dried in a Niro spray drier at 25 psi to form a spray dried agglomerate powder which, after screening, exhibited a Hall flow rate of about 30 seconds per 50 grams.

The agglomerate powder was used to form 15% copper composites. Each composite was formed by charging the appropriate amount of agglomerate powder into a die having a disk shape and compressing the powder in a press at a pressure of 25,000 psi to form a green compact. The green compact was then sintered at 1,140° C. for 45 minutes in an Astro-type furnace in a hydrogen atmosphere containing sufficient water to be saturated at 20° C. (dew point).

TABLE 6

| COMPONENT | AMOUNT (pounds) |
|---|---|
| Tungsten | 1,196 |
| Cuprous Oxide | 247.11 |
| Deionized Water | 346.41 |
| Cobalt | 5.98 |
| Rhoplex ® B-60A | 36.16 |

Example 5

Copper-phosphorus/tungsten composite parts were made using copper/tungsten spray dried powder and copper-phosphorus powder in the amounts shown in Table 7 below. The copper/tungsten spray dried powder contained 15% by weight copper in the form of copper oxide and was made according to the same procedure as described in Example 2.

Add the 15/85 copper/tungsten spray dry powder and copper-phosphorous to a blender. The contents of the blender were transferred into a die having a disk shape and the powder mix was pressed at a pressure of 20,000 psi to form a green compact. The compact of copper-phosphorus and copper/tungsten powder mix was fired at 1250° C. for 60 min. in an astro type furnace in a wet hydrogen atmosphere having a dew point of 20° C.

TABLE 7

| COMPONENT | AMOUNT (grams) |
|---|---|
| 15/85 Cu/W Spray Dry Powder (spray dry powder contained 15% copper as cuprous oxide) | 100 |
| Phos Copper (13.4% phosphorus, balance being copper) | 70 |

After the alloys were withdrawn from the furnace and cooled, they were visually inspected and their hardness and densities measured. The copper-phosphorous/tungsten parts had a Rockwell Hardness B of 95.1. It was determined that there was no metal bleedout. In addition, it was further determined that the average density of the parts was 10.56 g/cc. The densities of all parts were at least 97% of theoretical.

Example 6

Iron-copper-carbon steel parts were made using the raw materials used in Table 8 below. Carbonyl-iron powder, copper powder and cuprous oxide powder were mixed in a Turbula mixer for 20 min. The powder mix was then transferred into a die and the powder mix was pressed at a pressure of 10,000 psi in a uniaxial press to form a green compact having 61% theoretical density. The compact of powder mix was fired at 1120° C. for 60 min. in a vertical dilatometer set at a cycle of 10° C./min. in a dry 95% nitrogen/5% hydrogen atmosphere (dew point drier than −40° C.).

TABLE 8

| COMPONENT | AMOUNT (grams) |
|---|---|
| Reduced Carbonyl Iron Powder (ISP CIPR-1470) | 91.73 |
| Carbon (contained in the iron powder) | 0.27 |
| 500 RL Copper Powder | 4 |
| Cuprous Oxide | 4.5 |

Examination of the shrinkage rate curves revealed melt formation at 1050–1060° C. Total radial shrinkage was 17.61% and total longitudinal shrinkage was 11.20%. In addition, it was further determined that the density of the iron-copper-carbon part was 8.16 g/cc which corresponds to 100% of theoretical. Although a relatively small volume percent (5%) of hydrogen was used in the sintering atmosphere, full densification of the green compact was accomplished.

Example 7

Near net shape metal parts of copper-titanium/tungsten composites were produced using the raw materials listed in Table 9 below. The 15/85 copper/tungsten spray dry powder which contained 15% by weight copper in the form of copper oxide was made according to Example 2 above.

The copper/tungsten spray dry powder, copper powder and titanium powder were combined in a spex plastic jars containing milling media. The jars were filled to about 50% of the total volume and were place on a rolling mill at 110 rpm for 35 min. The powder mix was then discharged through a 60 mesh screen to separate the media. The powder mix was transferred into one inch diameter green sprills and compressed at a pressure of 20,000 psi. The green compact was then fired at 1250° C. for 60 min. in a wet hydrogen atmosphere (dew point of 20° C.).

TABLE 9

| COMPONENT | AMOUNT (grams) |
|---|---|
| 15/85 Cu/W Spray Dry Powder (spray dry powder contained 15% copper as cuprous oxide) | 100 |
| 500 RL Pure Copper | 63.2 |
| Titanium Powder (−100 mesh) | 6.8 |

After the composites were withdrawn from the furnace and cooled, they were visually inspected and their densities measured. As a result, it was determined that there was no metal bleedout. The parts had a Rockwell B Hardness of 62.2. In addition, it was further determined that the average density of the composites so made was 8.9 g/cc. The densities of all parts were at least 97% of theoretical.

Example 8

Copper-iron-tin-phosphorus/tungsten composite parts were made using the raw materials listed in Table 10. The 15/85 copper/tungsten spray dry powder containing 15% by weight copper in the form of cuprous oxide was made according to Example 2 above.

The 15/85 copper/tungsten spray dry powder, copper powder, carbonyl-iron powder, tin powder and copper-phosphorus powder were combined in a tumbling jar and mixed for 35 min. The powder mix was discharged through a 60 mesh screen and then collected into one inch diameter die sprills and uniaxially compressed at a pressure of 20,000 psi. The green compact was then fired at 1250° C. for 60 min. in a wet hydrogen atmosphere (dew point of 20° C.).

TABLE 10

| COMPONENT | AMOUNT (grams) |
|---|---|
| 15/85 Cu/W Spray Dry Powder (spray dry powder contained 15% copper as cuprous oxide) | 100 |
| 500 RL Copper Powder | 56 |
| Reduced Carbonyl Iron Powder | 6.8 |
| Tin Powder | 3.2 |
| Phos Copper (contained 13.4% phosphorus, balance being copper) | 4 |

After the composites were withdrawn from the furnace and cooled, they were visually inspected and their densities measured. As a result, it was determined that there was no metal bleedout. The parts had a Rockewell B Hardness of 89.7. In addition, it was further determined that the average density of the composites so made was 11.81 g/cc. The densities of all parts were at least 97% theoretical.

Example 9

A series of runs was conducted to show the effect of using chemically combined oxygen in the ingredient mix as well as the effect of water in the sintering atmosphere. In each run, composites were produced in accordance with the general procedure of Example 2. In runs A to D, metallic copper was used as the copper source while in runs E and F cuprous oxide was used as the copper source in accordance with the present invention. Also, in runs E and F, the sintering atmosphere was saturated in water at +25° C. and +20° C., respectively.

The results obtained are set forth in the following Table 11.

TABLE 11

| Run | Copper Source | Amount of Copper | Mean Particle Size | Temp (° C.) | Dewpoint (° C.) | Density (gg/cc) | % Theor. |
|---|---|---|---|---|---|---|---|
| A | Copper | 10% | 1.0 | 1475 | −70 | 16.15 | 94.44 |
| B | Copper | 10% | 1.0 | 1450 | −70 | 15.20 | 88.89 |
| C | Copper | 25% | 1.0 | 1450 | −70 | 13.91 | 94.63 |
| D | Copper | 40% | 1.0 | 1300 | −70 | 13.48 | 98.00 |
| E | Cupr. Oxide | 10% | 1.0 | 1400 | +25 | 17.10 | 100.00 |
| F | Cupr. Oxide | 15% | 1.0 | 1300 | +20 | 16.20 | 100.00 |

As can be seen from Table 11, runs using cuprous oxide as the copper source produced composites having densities of 100% theoretical, while those runs using copper metal as the copper source produced composites with densities less than 100% of theoretical. Furthermore, in run E in which the reducing atmosphere was saturated with water, the sintering temperature could be lowered 75° C. relative to run A in which the reducing atmosphere was dry.

This illustrates the remarkable enhancement that can be realized in terms of the sintering procedure carried out as well as the final product produced by including both chemically combined oxygen in the compaction mass and by further including water in the sintering atmosphere, as accomplished in accordance with the present invention.

Example 10

A series of runs was conducted using the general procedure of Example 4 to produce copper/tungsten composites, except that some or all of the tungsten carbide pulverizing media in the mill was replaced with copper/tungsten media. This resulted in the production of a series of composite products having various amounts of tungsten carbide contamination. Two separate series of runs were conducted. In one series, the reducing atmosphere used in sintering was dry (<−40° C. dewpoint) hydrogen. In the other series, the reducing atmosphere was wet (+20° C. dewpoint) hydrogen.

Figure 3:
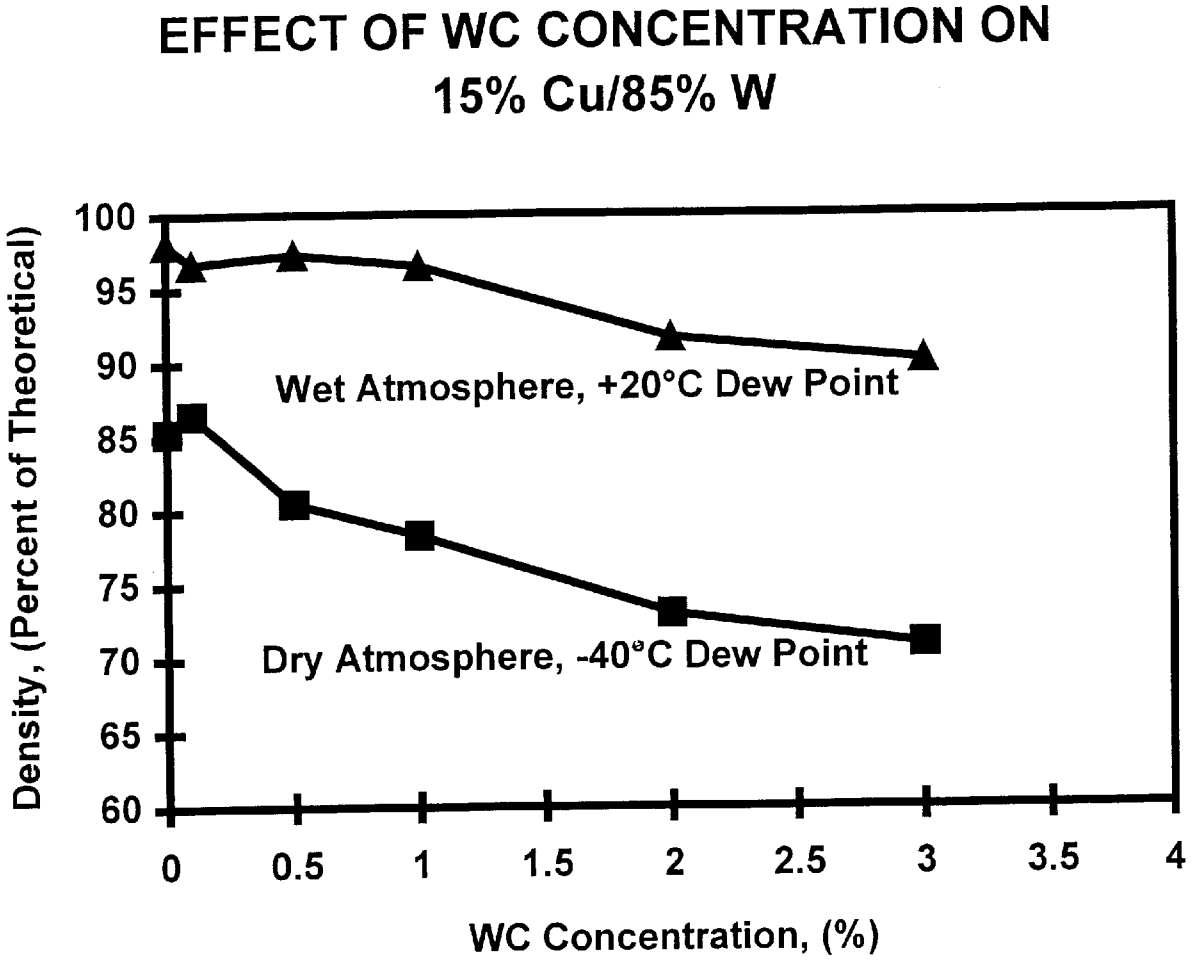
FIG. 3 is a graph illustrating the effect of tungsten carbide contamination, as well as the effect of moisture in the sintering atmosphere in a copper/tungsten composite produced in accordance with the present invention.

The composites obtained from each run were recovered and their densities determined. The results obtained are set forth in FIG. 3. From FIG. 3, it can be seen that in both series of runs, product density decreased as tungsten carbide concentration increased. This shows the significant negative effect of tungsten carbide contamination on copper tungsten composites.

By comparing the two series of runs, however, it can be seen that those runs in which water was included in the sintering atmosphere provided products with significantly higher densities than products made without water being present. This shows the significant positive effect water has on the sintering operation and the products obtained thereby when included in the sintering atmosphere.

Example 11

A series of runs was conducted using the general procedure of Example 2 to make copper/tungsten composites, except that the cobalt concentrations in the different runs were varied. The composite obtained from each run was recovered and their densities determined. The results obtained are set forth in FIG. 4.

Figure 4:
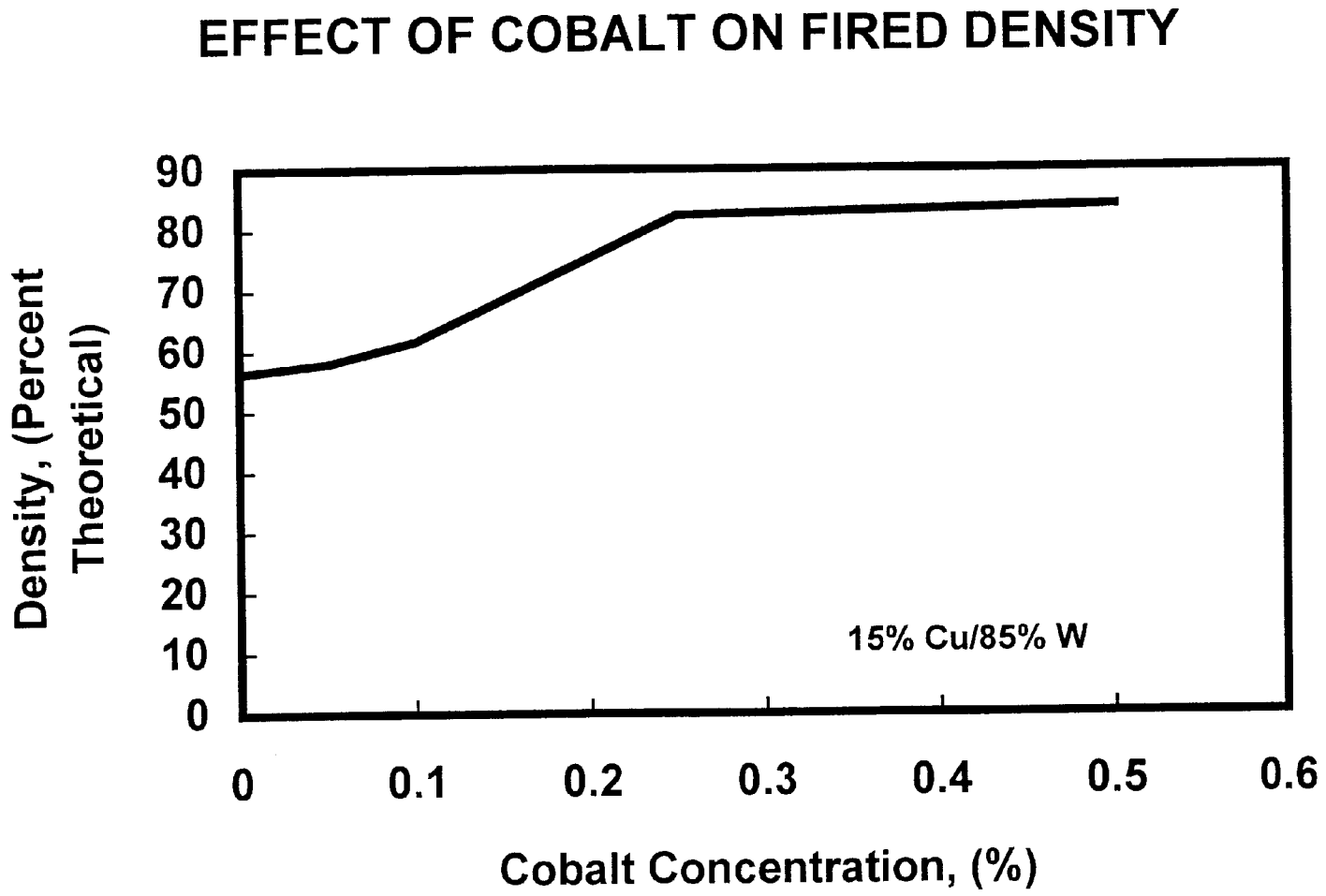
FIG. 4 is a graph illustrating the effect of cobalt as a sintering aid in a copper/tungsten composite formed in accordance with the present invention.

From FIG. 4, it can be seen that the concentration of cobalt in the particulate mixture to be fired has a significant effect on the density of the composite product obtained, at least until the cobalt concentrations reaches a certain value, about 0.3 wt. % in the particular embodiment shown.

Although only a few embodiments of the present invention have been described above, it should be appreciated that many modifications can be made without departing from the spirit and scope of the invention. For example, although the foregoing discussion relating to reducing spontaneous combustion of powdery sintering mixtures has been made in connection with forming copper/tungsten composites, it should be appreciated that this technique is applicable to any metal, metal oxide or other powdery material which exhibits spontaneous combustion. In particular, it is within the scope of the present invention to retard or eliminate spontaneous combustion of any fine particulate mass exhibiting the spontaneous combustion phenomenon by including in the mass sufficient corrosion inhibitor of the type described above to prevent spontaneous combustion from occurring. The amount of corrosion inhibitor needed for a particular application depends on the nature of the powdery mass being treated, both in terms of chemical composition and particle size, and can easily be determined by routine experimentation. Also, the corrosion inhibitor can be applied in any manner which will intimately admix the corrosion inhibitor with the other ingredients of the system. Preferably, as described above, the corrosion inhibitor is applied by mixing some or all of the particles in the mass subject to spontaneous combustion with a liquid containing the corrosion inhibitor preferably in solution.

All such modifications and variations of the present invention are possible in light of the above teachings. For example, additives and other modifying agents may be added to the compact of the present invention. It is understood, however, that changes may be made in the particular embodiments described above which are within the full intended scope of the invention as defined in the appended claims.

We claim:

1. A process for producing a net shape or near net shape metal part comprising sintering a compact containing particles consisting of a metal and chemically-bound oxygen in a reducing atmosphere, said metal being capable of forming a metal/metal oxide eutectic, and said compact containing chemically-bound oxygen in an amount sufficient to produce said eutectic.

2. The process of claim 1 wherein said metal and said chemically-bound oxygen are bound together in the form of a metal oxide, and said metal oxide is present in sufficient amount to improve sintering of the compact.

3. The process of claim 1 wherein said metal is selected from the group consisting of copper, nickel, chromium and iron.

4. The process of claim 1 wherein said compact further contains a solution compound, and wherein said net shape or near net shape metal part is an alloy.

5. The process of claim 4 wherein said solution compound is different than the metal present in the compact.

6. The process of claim 5 wherein said solution compound and said metal form a solid solution during sintering.

7. The process of claim 6 wherein said solution compound is selected from the group consisting of copper, nickel, iron, chromium, zinc, tin, beryllium, antimony, titanium, carbon, silver, cobalt, aluminum, niobium and combinations thereof.

8. A process for producing a net shape or near net shape metal part comprising sintering a compact containing particles consisting of a metal and chemically-bound oxygen in a reducing atmosphere, said metal being capable of forming a metal/metal oxide eutectic, and said compact containing chemically-bound oxygen in an amount sufficient to produce said eutectic, wherein said compact further contains a reinforcement compound which is insoluble to said metal under sintering conditions, and wherein said net shape or near net shape metal part is a metal matrix composite.

9. The process of claim 4 wherein said compact further contains a reinforcement compound which is insoluble to said metal and insoluble to said solution compound under sintering conditions, and wherein said net shape or near net shape metal part is a metal matrix composite.

10. The process of claim 8 wherein said reinforcement compound is selected from the group consisting of tantalum, molybdenum, tungsten, titanium carbide, tungsten carbide, tantalum carbide, chromium carbide, beryllium oxide, aluminum oxide, silicon carbide, boron nitride, aluminum nitride, silicon nitride and combinations thereof.

11. The process of claim 9 wherein said reinforcement compound is selected from the group consisting of tantalum, molybdenum, tungsten, titanium carbide, tungsten carbide, tantalum carbide, chromium carbide, beryllium oxide, aluminum oxide, silicon carbide, boron nitride, aluminum nitride, silicon nitride and combinations thereof.

12. The process of claim 8 wherein said reinforcement compound has a melting temperature higher than the melting temperature of said metal.

13. The process of claim 9 wherein said reinforcement compound has a melting temperature higher than the melting temperature of said solution compound.

14. A process for producing a net shape or near net shape metal part comprising sintering a compact containing particles consisting of a metal and chemically-bound oxygen in a reducing atmosphere, said compact containing chemically-bound oxygen in an amount sufficient to produce a metal/metal oxide eutectic, said metal being selected from the group consisting of copper, nickel, iron and chromium, wherein said compact further contains a solution compound, said solution compound being different than said metal and being soluble to said metal under sintering conditions, said solution compound being selected from the group consisting of copper, nickel, iron, beryllium, titanium phosphorus, and combinations thereof, said compact further containing a reinforcement compound which is insoluble to said metal and said solution compound under sintering conditions, said reinforcement compound being selected from the group consisting of tungsten, molybdenum, carbon and combinations thereof, and wherein said near net shape metal part is a metal matrix composite.

15. The process of claim 1 wherein said chemically-bound oxygen is present in the form of metal oxide, wherein the weight of metal oxide is at least about 1% of the total amount of metal in said compact.

16. The process of claim 4 wherein said chemically-bound oxygen is present in the form of metal oxide, wherein the weight of metal oxide is at least about 1% of the total amount of metal in said compact.

17. The process of claim 8 wherein said chemically-bound oxygen is present in the form of metal oxide, wherein the weight of metal oxide is at least about 1% of the total amount of metal in said compact.

18. The process of claim 1 wherein said reducing atmosphere contains hydrogen.

19. The process of claim 4 wherein said reducing atmosphere contains hydrogen.

20. The process of claim 8 wherein said reducing atmosphere contains hydrogen.

21. The process of claim 9 wherein said reducing atmosphere contains hydrogen.

22. The process of claim 1 wherein said reducing atmosphere includes moisture in an amount sufficient to improve sintering of said compact.

23. The process of claim 4 wherein said reducing atmosphere includes moisture in an amount sufficient to improve sintering of said compact.

24. The process of claim 8 wherein said reducing atmosphere includes moisture in an amount sufficient to improve sintering of said compact.

25. The process of claim 9 wherein said reducing atmosphere includes moisture in an amount sufficient to improve sintering of said compact.

26. A process for producing a net shape or near net shape metal part comprising sintering in a reducing atmosphere a compact containing particles of copper, copper oxide and a reinforcement compound, said reinforcement compound being selected from the group consisting of tungsten and molybdenum, said compact containing at least about 1% by weight copper oxide based on the amount of copper in said compact, said reducing atmosphere contains hydrogen, and said metal part is a metal matrix composite.

27. A process for producing a net shape or near net shape metal part comprising sintering a compact containing particles consisting of a metal and chemically-bound oxygen in a reducing atmosphere, said metal being capable of forming a metal/metal oxide eutectic, and said compact containing chemically-bound oxygen in an amount sufficient to produce said eutectic wherein said metal particles having a mean particle size of 0.3 to 10 microns is spray dried to form a flowable mass of agglomerates having an angle of repose of about 35 degrees or less and a flowability of 40 seconds or less per 50 grams, wherein said flowable mass of agglomerates is compacted to form a self-supporting shaped article, and wherein said shaped article is sintered in a reducing atmosphere of hydrogen containing moisture in an amount such that said atmosphere has a dew point of from about −40° C. to about +20° C.

28. The process of claim 19 wherein said agglomerates contain an organic binder.

29. The process of claim 20 wherein said compact further comprises a sintering aid in an amount sufficient to improve sintering.

30. The process of claim 20 wherein said agglomerates are formed into said compact without having reduced said chemically-bound oxygen in said agglomerates.

31. The process of claim 8 wherein said metal is copper and said reinforcement compound contains tungsten or molybdenum and has been treated with a corrosion inhibitor.

32. The process of claim 9 wherein said metal is copper and said reinforcement compound contains tungsten or molybdenum and has been treated with a corrosion inhibitor.

33. The process of claim 1 wherein said metal and said chemically-bound oxygen are bound together in the form of a metal oxide, wherein said metal oxide is at least about 4% by weight based on the amount of said metal in said compact, said reducing atmosphere contains hydrogen and moisture at a dew point from about −40° C. to about +20° C., and said compact further contains a sintering aid in an amount sufficient to improve sintering of said compact.

34. The process of claim 4 wherein said metal and said chemically-bound oxygen are bound together in the form of a metal oxide, wherein said metal oxide is at least about 4% by weight based on the amount of said metal in said compact, said reducing atmosphere contains hydrogen and moisture at a dew point from about −40° C. to about +20° C., and said compact further contains a sintering aid in an amount sufficient to improve sintering of said compact.

35. The process of claim 8 wherein said metal and said chemically-bound oxygen are bound together in the form of a metal oxide, wherein said metal oxide is at least about 4% by weight based on the amount of said metal in said compact, said reducing atmosphere contains hydrogen and moisture at a dew point from about −40° C. to about +20° C., and said compact further contains a sintering aid in an amount sufficient to improve sintering of said compact.

36. The process of claim 4 wherein said metal and said chemically-bound oxygen are bound together in the form of a metal oxide, wherein said metal oxide is at least about 4% by weight based on the amount of said metal in said compact, said reducing atmosphere contains hydrogen and moisture at a dew point from about −40° C. to about +20° C., and said compact further contains a sintering aid in an amount sufficient to improve sintering of said compact.

37. A sintered metal part made by the process of claim 1 wherein said composite has a density of at least about 90% of its theoretical density.

38. A sintered metal part made by the process of claim 3 wherein said composite has a density of at least about 90% of its theoretical density.

39. A sintered alloy part made by the process of claim 4 wherein said alloy has a density of at least about 90% of its theoretical density.

40. A sintered alloy part made by the process of claim 5 wherein said alloy has a density of at least about 90% of its theoretical density.

41. A sintered metal matrix composite part made by the process of claim 8 wherein said metal matrix composite has at least 90% of its theoretical density.

42. A sintered metal matrix composite part made by the process of claim 9 wherein said metal matrix composite has at least 90% of its theoretical density.

* * * * *